United States Patent [19]

Patrice

[11] Patent Number: 4,802,359

[45] Date of Patent: Feb. 7, 1989

[54] TOOL FOR MEASURING PRESSURE IN AN OIL WELL

[75] Inventor: Corjon Patrice, Alkmaar, Netherlands

[73] Assignee: Schlumberger Technology Corporation, Houston, Tex.

[21] Appl. No.: 112,905

[22] Filed: Oct. 23, 1987

[30] Foreign Application Priority Data

Oct. 30, 1986 [FR] France ..... 86 15166

[51] Int. Cl.[4] ..... E21B 47/00

[52] U.S. Cl. ..... 73/151; 166/250; 166/319; 166/331

[58] Field of Search ..... 73/151; 166/331, 332, 166/334, 240, 317, 319, 106, 113, 250

[56] References Cited

U.S. PATENT DOCUMENTS

| | | | |
|---|---|---|---|
| 3,120,267 | 2/1964 | Bayless | 166/332 X |
| 3,662,826 | 5/1972 | Young et al. | 166/331 X |
| 4,069,865 | 1/1978 | Gazda et al. | 166/152 X |
| 4,274,486 | 6/1981 | Fredd | 166/319 X |
| 4,316,386 | 2/1982 | Kerekes | 73/151 |
| 4,354,554 | 10/1982 | Calhoun et al. | 166/321 |
| 4,373,583 | 2/1983 | Waters | 166/334 X |
| 4,392,377 | 7/1983 | Rankin | 73/155 |
| 4,403,659 | 9/1983 | Upchurch | 166/331 X |
| 4,440,221 | 4/1984 | Taylor et al. | 166/321 X |
| 4,452,313 | 6/1984 | McMahan | 166/323 X |
| 4,453,599 | 6/1984 | Fredd | 166/332 X |
| 4,605,074 | 8/1986 | Barfield | 166/317 X |

FOREIGN PATENT DOCUMENTS

| | | | |
|---|---|---|---|
| 0023399 | 7/1980 | European Pat. Off. . | |
| 2913896 | 4/1979 | Fed. Rep. of Germany . | |
| 0442291 | 9/1974 | U.S.S.R. | 166/113 |
| 2029873 | 3/1980 | United Kingdom | 166/319 |
| 2047772 | 12/1980 | United Kingdom | 166/319 |
| 2110743 | 11/1982 | United Kingdom . | |

*Primary Examiner*—Eugene R. LaRoche
*Assistant Examiner*—Seurg Ham
*Attorney, Agent, or Firm*—Henry N. Garrana; John H. Bouchard

[57] ABSTRACT

The invention relates to a tool for measuring pressure in the annular space lying between casing and the production string of an oil well. The tool comprises two sliding elements, with the first element being temporarily locked in a section of the string constituting a circulating valve and with the second element carrying a pressure sensor which receives the pressure reigning in the annular space via a duct and orifices of the circulating valve after they have been brought into register.

21 Claims, 5 Drawing Sheets

TOOL FOR MEASURING PRESSURE IN AN OIL WELL

BACKGROUND OF THE INVENTION

The present invention relates to a tool for measuring the pressure created in an oil well by the underground formation where the well is drilled, with the well being delimited by casing having production string installed therein, and with the string including a section that constitutes a sliding sleeve circulating valve or sliding side door (SSD), said valve being capable, on command, of putting the space inside the string into communication with the annular space lying between the string and the casing. This is done by bringing orifices through the wall of said section and through the sliding sleeve into register.

Pressure measurements in oil wells provide important information on the characteristics of the oil-bearing formations through which they are drilled. In wells where production is obtained by means of electric pumping, the pressure drop due to a sudden momentary increase in the flow rate at the surface can be used to calculate the production index, i.e. the production capacity of the well as a function of pressure drop. Given this index, which depends on the permeability and on the size of the reservoir constituted by the underground formation, it is possible to adjust the production flow rate to its optimum value.

It is also possible to set up an increase in pressure in a well by suddenly stopping pumping. The rate of this increase and its form as a function of time characterize the manner in which the reservoir responds and make it possible to evaluate its size and its porosity, to discover whether it is fractured, etc., thereby giving rise to a better description of the reservoir and to a more accurate understanding of its future capabilities and of the advisability of drilling other wells in its vicinity.

In a third application relating to wells which are exploited by electrical pumping, it is possible to evaluate the efficiency of the pump being used and to detect possible damage which may be shown up by abnormal variations in efficiency, by measuring the pressure created by the underground formation at a given depth, i.e. the pressure reigning in the above-mentioned annular space, while simultaneously measuring the pressure in the string at the same depth, which pressure depends on pumping characteristics.

The pressure created by the underground formation must be measured in the annular space lying between the casing and the production string. The height of the column of oil in said annular space is directly related to this pressure, and proposals have been made to measure this height from the go and return time of an acoustic wave emitted from the surface of the ground and reflected from the air-oil interface of the column. However, this procedure is not usable when the annular space is closed at the top by sealing means known as a packer.

Attempts have also been made to measure the pressure at the bottom of a well which is being exploited by electrical pumping by associating a pressure sensor with the pump. The results obtained in this way have been unsatisfactory since the pressure data provided by such a sensor (which must remain at the bottom of the well for as long as the pump remains at the bottom) falls off in quality over the years. In addition, the electrical signals delivered by the sensor are mixed with noise. As a result measuring accuracy is very mediocre.

Another proposal consists in placing a pressure gauge on the outside surface of the production string. However, the presence of said packer (i.e. sealing means) in the annular space interferes with passing an electrical cable connected to the pressure gauge since that cable must reach the surface by running up the annular space.

SUMMARY OF THE INVENTION

In order to solve the problem of measuring pressure in oil wells, the present invention provides a tool designed to be lowered inside the production string and locked at the level of the section which includes the circulating valve SSD with the valve in its open state. This tool includes means for putting the orifices of said valve (when brought into register) into sealed connection with a pressure sensor, - said connection being sealed against pressure reigning in the production string, - such that said sensor has the pressure reigning in the above-mentioned annular space level with said section applied thereto via said orifices and said sealed connection means.

Thus, by virtue of such a tool which takes advantage of the circulating valve already present in the production string, all of the equipment required for measuring pressure and including said tool, namely the pressure sensor and the associated members which enable the tool to be put into place, may be contained inside the production string so that the presence of a packer (sealing means) no longer constitutes an obstacle since nothing needs to be lowered or installed inside the annular space. Further, the tool can be removed at the end of a pressure measurement cycle by being raised up the production string in the same way as the tools which are conventionally used in oil drilling applications.

In an advantageous embodiment of the invention, the tool comprises two coaxial elements capable of sliding telescopically, namely a first tubular element whose outside diameter is slightly less than the inside diameter of the production string, and a second element capable of sliding over a limited stroke in an inside bearing of the first element and including a duct for providing sealed connection between the pressure sensor and said orifices. This disposition makes it possible to disengage the top of the first element by retracting the second element inside the first, thereby making it easier to grasp the first element by a lowering or raising tool, optionally via an anchoring mandrel fixed to the first element and maneuverable by means of a lowering or fishing tool, and which is lockable in the section constituting the circulating valve of the production string.

It is also advantageous for the second element to be able to take up, relative to the first element, firstly a low position determined by an end-of-stroke abutment in which the second element is entirely contained within the first element, and secondly a high position, likewise determined by an end-of-stroke abutment, in which said duct is put into communication with the orifices of the circulating valve. According to another characteristic of the invention, this duct opens out onto the outside surface of the second element at a position such that when said element is in its high position the opening of the duct is situated in the middle region of the internal bearing surface of the first element and is thus in communication with at least one channel passing through the wall of the first element and itself in communication, via an annular space lying between the outside surface of the first element and the inside surface of the sliding sleeve, with the orifices through the sleeve and through the wall of the section constituting the circulating valve. Further, in order to make it possible for the second element to take up any orientation about the longitudinal axis of the tool it is advantageous for the above duct to open out into an annular groove formed in the inside bearing of the first element and communicating with the or each channel passing through the wall thereof.

In an advantageous embodiment, the pressure sensor is carried by the tool and is preferably mounted on the tool in removable manner so that the tool and the pressure sensor may be maneuvered independently. To this end, according to another characteristic of the invention, the top of the second element of the tool includes a tubular junction end fitting with said connection duct ending in said end fitting and serving to connect the duct in sealed manner to the pressure sensor. Further, the pressure sensor is preferably coupled to the end fitting via separable connection including fingers which cooperate with a system of J-grooves and enabling the pressure sensor to be coupled with and then decoupled from the end fitting under control from the surface of the ground by means of a suspension cable.

In order to allow oil to pass through the tool when in place in the production string, it is advantageous for the second element of the tool to include a lower tubular portion having at least one orifice at the top thereof. Further, pressures within the production string may be equalized when the tool is removed by providing for the abutment defining the low position of the second element to be constituted by a ring which is fixed in non-final manner in the first element and which closes at least one orifice passing through the wall of the first element, with said ring being expelled at the end of tool use by means of a fishing tool designed to force the second element to move down relative to the first, thereby uncovering said orifice which then puts the spaces situated inside and outside the first element into communication.

Other characteristics and advantages of the invention appear more clearly from the following description of a non-limiting embodiment of the invention given with reference to the accompanying drawings.

DETAILED DESCRIPTION

Figure 1:
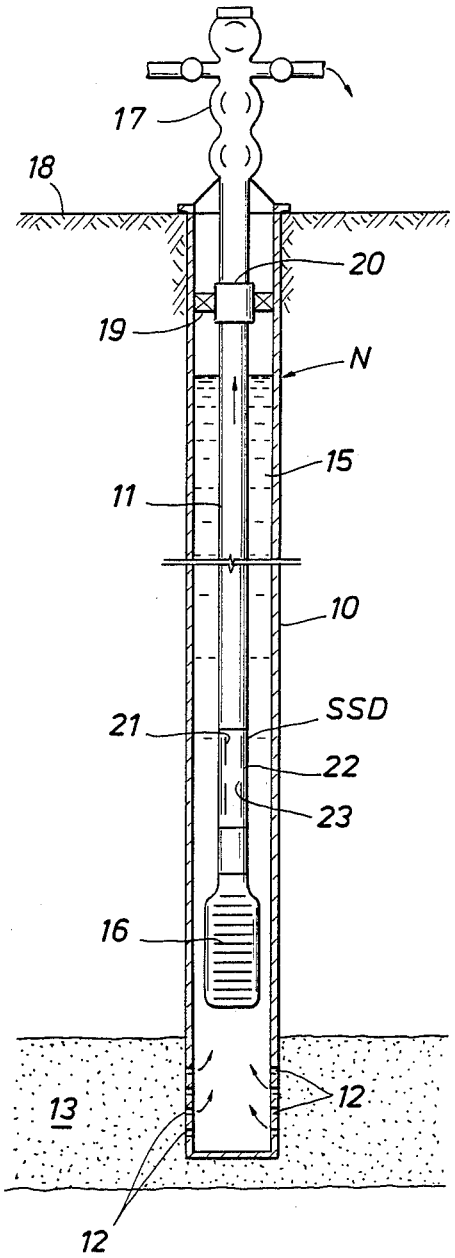
FIG. 1 is a diagrammatic longitudinal section through an oil well fitted with production string including a section constituting a circulating valve.

FIG. 1 shows an oil well delimited by casing 10 and having production string 11 installed therein. The casing 10 includes perforations 12 in an oil-bearing formation 13 where the well is drilled, and via which oil penetrates into the well. By virtue of its pressure, the oil rises to a level N (situated beneath the ground surface 18) inside the annular space 15 between the casing 10 and the production string 11. A submerged pump 16 (fitted with a non-return valve) is mounted at the bottom of the production string and serves to deliver oil up said string to the surface where it is made available on a Christmas tree 17. Not far from the ground surface 18, the annular space 15 is closed by circular sealing means known as a packer 19, and a safety valve 20 may be disposed at that level. A short way above the pump 16, the production string 11 includes a circulating valve section SSD comprising a sliding sleeve 21 which can be operated to provide a communication path between the inside of the production string 11 and the annular space 15 (mainly for the purpose of killing the well by filling it with mud), by putting orifices 22 and 23 provided respectively through the wall of the section SSD extending the wall of the production string 11 and through the sliding sleeve 21 into communication with each other.

It is this communication path which is used by a tool in accordance with the invention as described below for the purpose of measuring the oil pressure in the annular space 15 not far from the formation 13.

Figure 2:
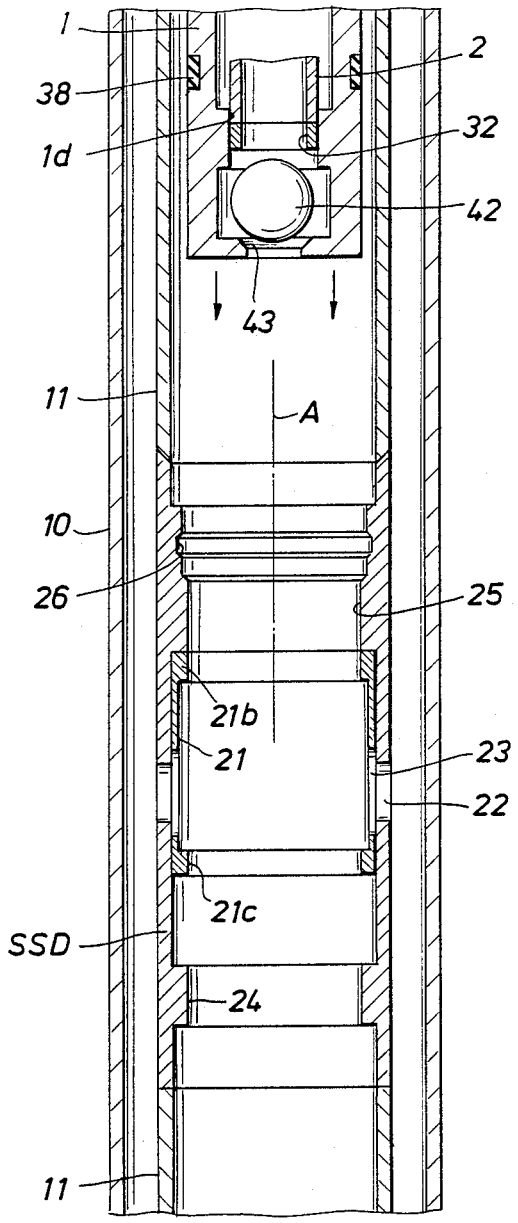
FIGS. 2, 3, and 4 are diagrams in longitudinal section and to a larger scale showing a tool in accordance with the invention respectively while being lowered down the production string, after being put into place in the section constituting a circulating valve, and while in service for performing pressure measurements.
Figure 4:
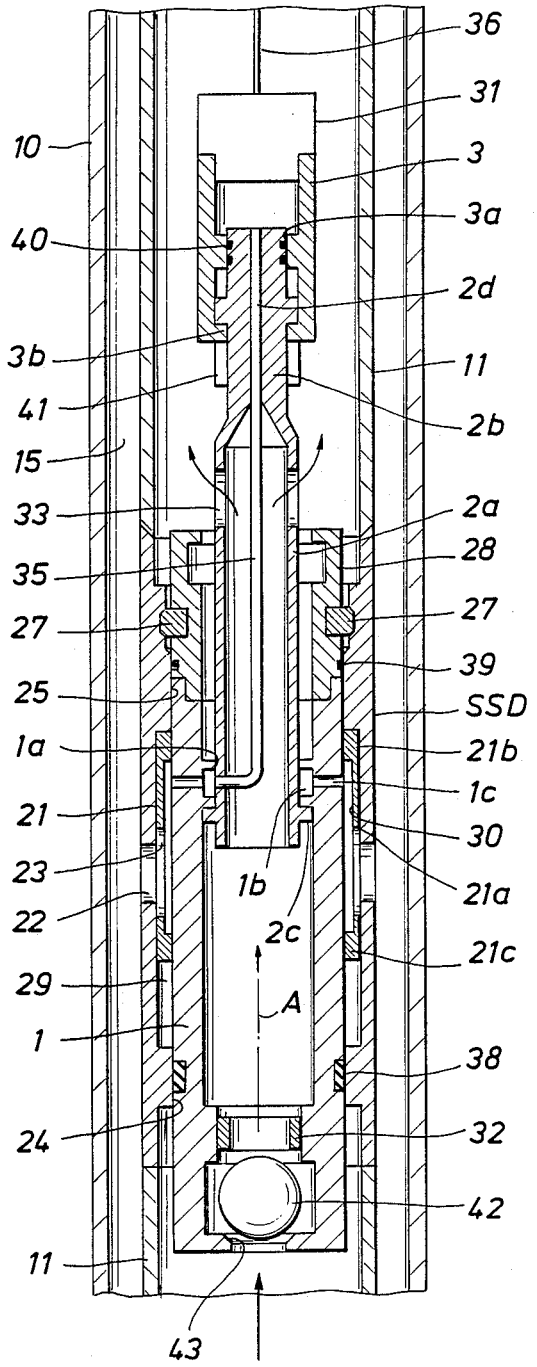

As shown in diagrammatic and simplified form in FIG. 4, a tool in accordance with the invention essentially comprises two elements 1 and 2 which are generally tubular in shape and which are disposed coaxially about the axis A of the production string 11. The larger diameter element 1 is capable of sliding inside the production string 11 and the smaller diameter element 2 is capable of sliding inside the element 1. More precisely, the outside surface of the element 1 which is in the form of a circular cylinder has a diameter which is selected so as to enable it to be a sliding fit inside two internal sealing bearing surfaces 24 and 25 provided on the section SSD of the production string on either side of the moving sleeve 21, said bearing surfaces also limiting the sliding stroke thereof. The top bearing surface 24 includes an annular groove 26 (see FIG. 2) for receiving the locking keys 27 of an anchoring mandrel 28 which is fixed to the top end of the element 1. Near the bottom end of the element 1 there is a sealing ring 38 which co-operates with the bottom sealing bearing surface 24 of the section SSD when the element 21 is fixed in the section SSD by means of the anchoring mandrel 28 locking via its keys 27 (FIG. 4). As a result, the oil delivered by the pump 16 into the production string 11 can only flow along the inside volume of the element 1.

The sliding sleeve 21 is received in the annular space 29 delimited by the inside surface of the section SSD, its bearing surfaces 24 and 25, and the outside surface of the element 1. The outside diameter of the sleeve 21 corresponds to the inside diameter of the section SSD between said bearing surfaces. However, the inside diameter of the sleeve is greater than the outside diameter of the element 1 so that an annular space 30 appears between the element 1 and the sleeve 21. The orifices 22 through the section SSD are naturally situated between the bearing surfaces 24 and 25, whereas the lengthwise positions (relative to the sleeve) of the orifices 23 through the sleeve 21, and the length of the sleeve itself, are selected in such a manner that depending on the extreme longitudinal position occupied by the sleeve within the section SSD, these orifices either come face-to-face into register with the orifices 22 through the section SSD, thereby putting the space 30 into communication with the space 15 surrounding the section SSD, or else the orifices 22 are closed by the cylindrical wall 21a of the sleeve 21. Each end of the sleeve includes in inwardly directed annular rim 21*b* or 21*c* to provide engagement with an actuator member for sliding the sleeve upwardly or downwardly.

Figure 3:
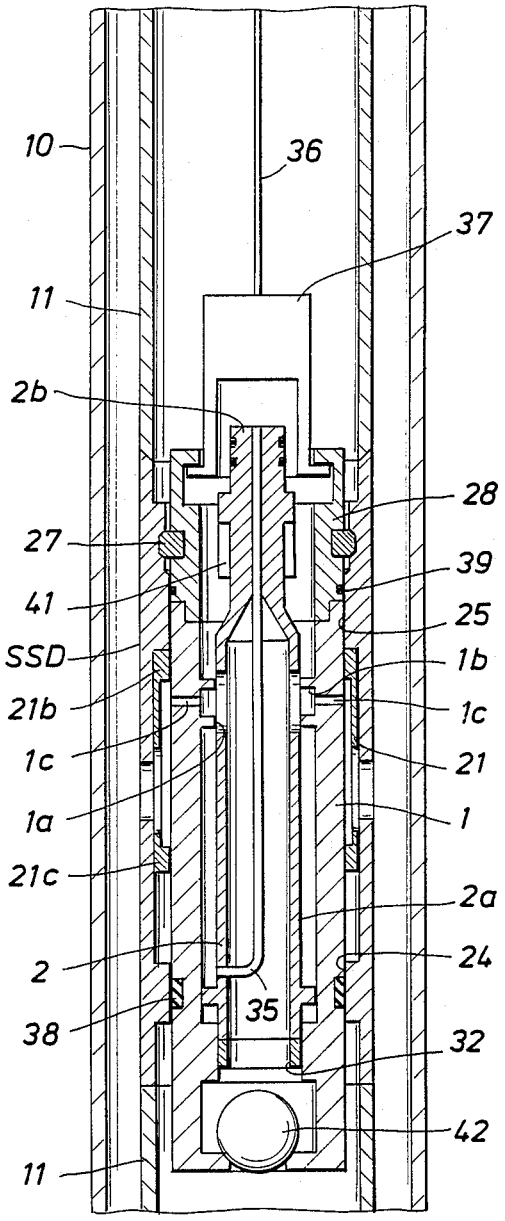

The element 2 is essentially constituted by a hollow cylindrical portion 2*a* together with an end fitting 2*b* which extends beyond the top end of the hollow cylindrical portion for the purpose of connection to a pressure sensor 31. The portion 2*a* whose outside diameter is slightly less than the inside diameter of the element 1 is capable of sliding longitudinally therein and of being guided by an internal bearing surface 1a which projects inwardly from the inside surface of the element 1. The upwards excursion of the element 2 is limited by an outwardly directed collar 2*c* on the portion 2a near the bottom end thereof coming into abutment against said inside bearing surface 1a of the part 1, and its downward excursion is limited by a ring 32 fixed inside the element 1 and against which the bottom end of the element 2 comes into abutment (FIG. 3). The top end of the portion 2*a* has orifices 33 passing therethrough to enable oil to flow through the tool, via the inside spaces of the element 1 and said portion 2*a* of the element 2.

The inside bearing surface 1a of the element 1 has an annular groove 1*b* formed therein which is open towards the inside of the element and which is connected to the space surrounding it via channels 1c passing radially through its cylindrical wall. The element 2 includes a duct 35 which is connected at one end to a channel 2*d* running axially through its end fitting 2*b*, and opens out at its other end through the cylindrical wall of its portion 2*a* into the above-mentioned annular groove 1*b* when the element 2 is in its high abutment position inside the part 1, as shown in FIG. 4. Under these conditions, the annular space 30 which communicates via the orifices 23 and 22 with a space 15 surrounding the section SSD is in connection with the axial channel 2*d* of the end fitting 2*b*, via the channels 1*c*, the groove 1*b*, and the duct 35, regardless of the orientation of the element 2 about the axis A. As to the end fitting 2*c*, it may be put into connection with the pressure sensor 31 by means of a junction sleeve 3 connected in sealed manner at its top end to said sensor and via an inside bearing surface 3*a* to the end fitting 2*b*.

In order to allow the pressure sensor 31 to be put into place and to be removed, the sleeve 3 may be fastened to the end fitting 2*b* or it may be removed therefrom at will simply by imparting axial displacement thereto by means of a suspension cable 36 to which it is attached, in a manner described below.

When pressure measurements are to be made in the well, the tool 1, 2 is lowered down the production string 11 to be put into position level with the circulating valve forming section SSD. The sliding sleeve 21 of this section which is normally in the closed position will have previously been put into its open position such that the orifices 22 and 23 are face-to-face. While the tool is being lowered (FIG. 2), its element 2 is in its low position inside the part 1 resting against the ring 32 fixed to the bottom thereof, thereby disengaging the anchoring mandrel 28 and enabling the mandrel to be coupled to a lowering tool 37 (see FIG. 3) attached to the suspension cable 36. Finally, the keys 27 of the anchoring mandrel 28 are engaged in the groove 26 of the top bearing surface 25 of the section SSD, thereby fixing the tool therein with the channels 1*c* of the part 1 opening outwardly into the annular space 30 lying between the rims 21*b* and 21*c* of the sleeve 21, and with the sealing ring 38 of the part 1 being face-to-face with the bottom bearing surface 24 of the section SSD to provide sealed contact at said location beneath the sleeve 21. Above the sleeve, sealing is likewise ensured by a sealing ring 39 belonging to the anchoring mandrel 28 and co-operating with the top bearing surface 25.

While the tool 1, 2 is being lowered, pressure is equalized in the production string 11 between the spaces situated above the tool and below the tool via the channels 1*c*.

Figure 7:
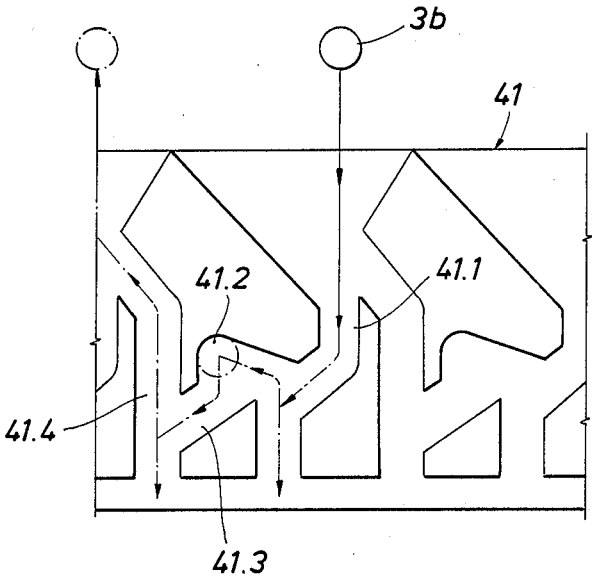
FIG. 7 is a diagram in the form of a plane development of a portion of the peripheral surface of a J-groove drum included in the tool in order to connect and disconnect the pressure sensor.

After the tool 1, 2 has been put into place, the lowering tool 37 is detached and raised to the surface by means of the cable 36. Then, the same cable is used to lower the junction sleeve 3 carrying the pressure sensor 31. This sleeve fits in sealed manner via its inside bearing surface 3*a* fitted with a sealing ring 40 onto the end fitting 2*b* of the element 2 of the tool. Thus, the sensor 31 is put into communication with the duct 35 via the channel 2*c* through the end fitting 2*b* (FIG. 4). At the same time, a pair of fingers 3*b* with which the sleeve 3 is provided come into engagement with a system of grooves 41 which appear on the outside surface of a drum-shaped portion of the end fitting 2*b* and which constitute (see FIG. 7) a succession of J-shaped grooves which are so designed that by lowering and raising the sleeve 3 slightly, its fingers 3*b* move down vertical passages 41.1 and are then received in notches 41.2, with the parts 2 and 3 then being coupled together. Next time the sleeve 3 is lowered and then raised, the fingers 3*b* move down along sloping passages 41.3 and then rise up passages 41.4 so as to escape from the system of grooves 41, with the part 2 and 3 then being disconnected (and so on).

In the FIG. 4 configuration, the tool 1, 2 puts the associated pressure sensor 31 which is likewise immersed in the oil contained in the production string 11 into communication with the annular space 15 surrounding the production string so as to enable measurements to be made of the pressure of the oil contained therein. In parallel, throughout the time that the tool 1, 2 is in service in the production string 11, oil may rise under the delivery effect of the pump 12 along said string by passing through the tool with minimum interference, via a non-return valve constituted by a ball 42 and a conjugate circular seat 43 provided at the bottom of the element 1, followed by the inside space thereof, the inside space of the portion 2*a* of the element 2, and the orifices 33 thereof (FIG. 4). Said non-return valve is in addition to the nonreturn valve which is fitted to the pump 16 and takes over therefrom in the event of a leak.

The efficiency of the pump 16 may be determined by associating the pressure sensor 31 with a second pressure sensor (not shown) which measures the pressure inside the production string.

Figure 5A:
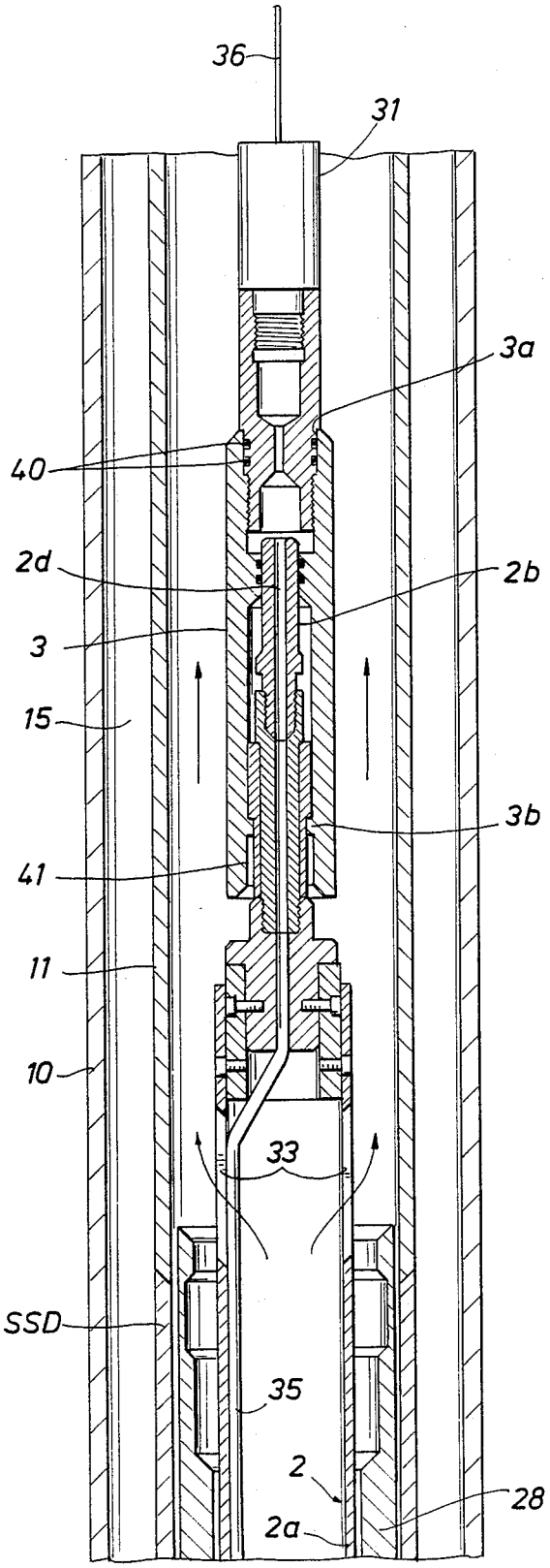
FIGS. 5A, 5B, and 5C which are interconnected along lines AB and CD shown a practical embodiment of an entire tool in longitudinal section.
Figure 5B:
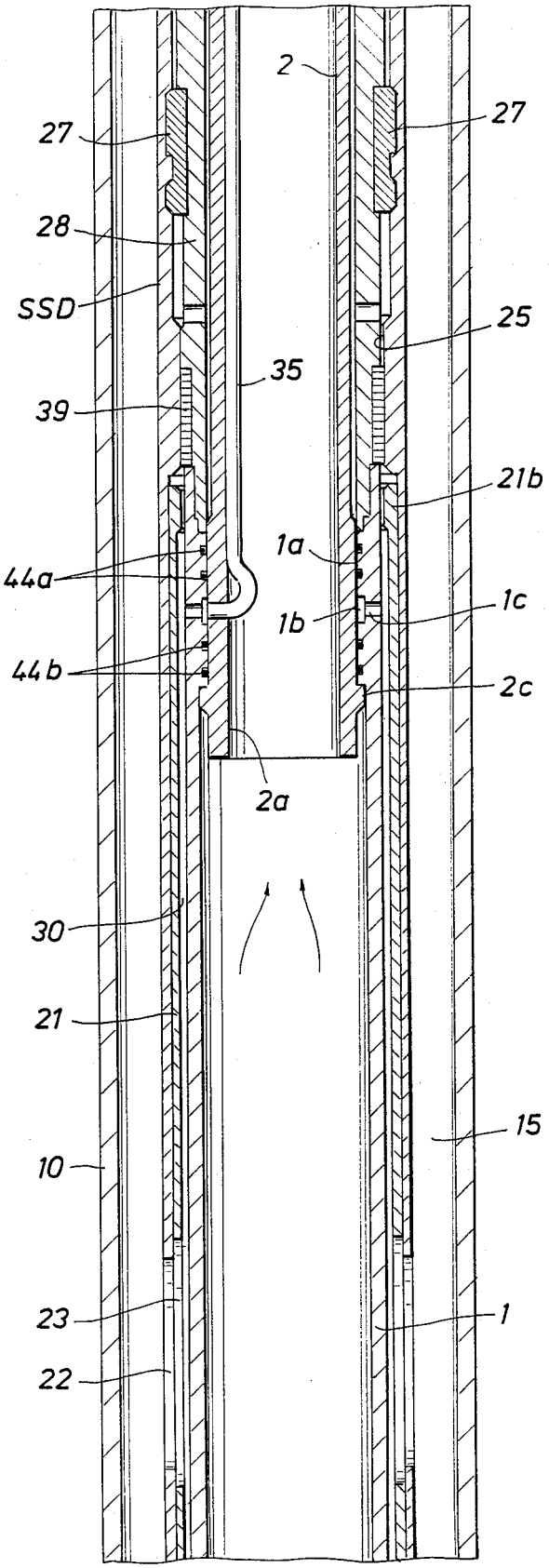
Figure 5C:
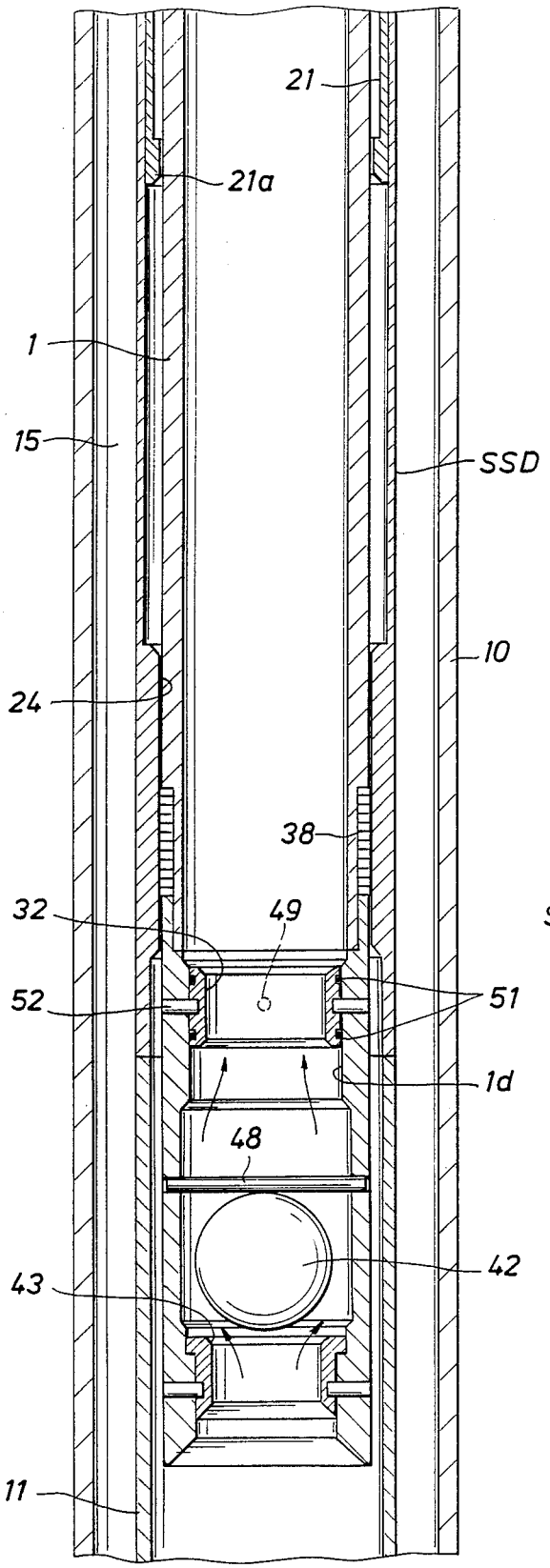

FIGS. 5A, 5B, and 5C show a concrete example of a tool embodying the invention in its FIG. 4 configuration. The various component parts of the well and the tool outlined in FIG. 4 can be recognized therein, namely:

the production string 11 which is coaxial with the casing 10, and including a circulating valve section SSD fitted with the sleeve 21 capable of sliding between the inside bearing surfaces 24 and 25, with the respective orifices 22 and 23 being shown, in this case, face-to-face;

element 1 of the tool (constituted by an assembly of several parts) which is screwed to the anchoring mandrel 28 and which is held fixed in the section SSD by locking keys 27 on the mandrel, with sealing on either side of the sliding sleeve 21 being provided by inside bearing surfaces 24 and 25 cooperating with sealing rings 38, 39;

element 2 of the tool (constituted by an assembly of several parts) sliding in the inside bearing 1*a* of element 1 by means of its tubular portion 2*a*, the top of which includes the through orifices 33 and terminates by end fitting 2*b*;

the duct 35 leaving end fitting 2b and going down inside the part 2*a* of element 2 and then passing through the wall thereof to open out into the annular groove 1*b* formed in the bearing surface 1*a* of element 1 between two groups of sealing rings 44*a* and 44*b* provided on this bearing surface, with the groove 1*b* communicating via channels 1*c* with the annular space 30 lying between the element 1 and the sliding sleeve 21;

the junction sleeve 3 coupled in sealed manner to the end of end fitting 2*b* via its internal bearing surface 3*a* which is provided with two sealing rings 40, and engaging the end fitting 2*b* via a pair of fingers 3*b* engaged with the J-grooves 41 of said end fitting, with the pressure sensor 31 being coupled in sealed manner to said junction sleeve;

the ring 32 fixed inside the element 1 and defining the bottom position of the sliding element 2, with its top position being defined by the valve in abutment of the flange 2*c* against the bearing surface 1*a* of element 1; and the non-return valve 42, 43 disposed at the bottom end of the element 1, beneath the ring 32.

It can be deduced from the set of FIGS. 5A, 5B, and 5C that unlike the diagram of FIG. 3, the element 2 is completely contained inside the element 1 when in its bottom position pressed against the ring 32, with its end fitting 2*a* terminating beneath the bearing surface 1*a* of the element 1 and beneath the orifices 1*c*. Thus, in this situation, the anchoring mandrel 28 is completely free to enable the lowering tool 37 to be fastened thereto.

In addition, FIG. 5C shows the presence of an orifice 49 through the wall of the element 1 of the tool and suitable for putting the spaces situated on either side of said wall into communication. However, in the normal situation shown, this orifice is closed and rendered inoperative by the ring 32 which co-operates with an internal bearing 1*d* of the element 1 in sealed contact by virtue of a pair of sealing rings 51, with the orifice 49 being located therebetween. Thus, this orifice opens out on the inside of the element 1 into a narrow closed annular chamber which is delimited by the bearing surface 1*d*, the periphery of the ring 32, and the pair of sealing rings 51. As explained below, the orifice 49 may be put into operation by expelling the ring 32 since this is fixed in the bearing surface 1*d* by a pair of shearable pins 52. Naturally, instead of a single orifice 49, there could be a plurality of orifices 49 likewise located between the two sealing rings 51 while the ring 32 is in position in the bearing surface 1*d* of the element 1.

Figure 6:
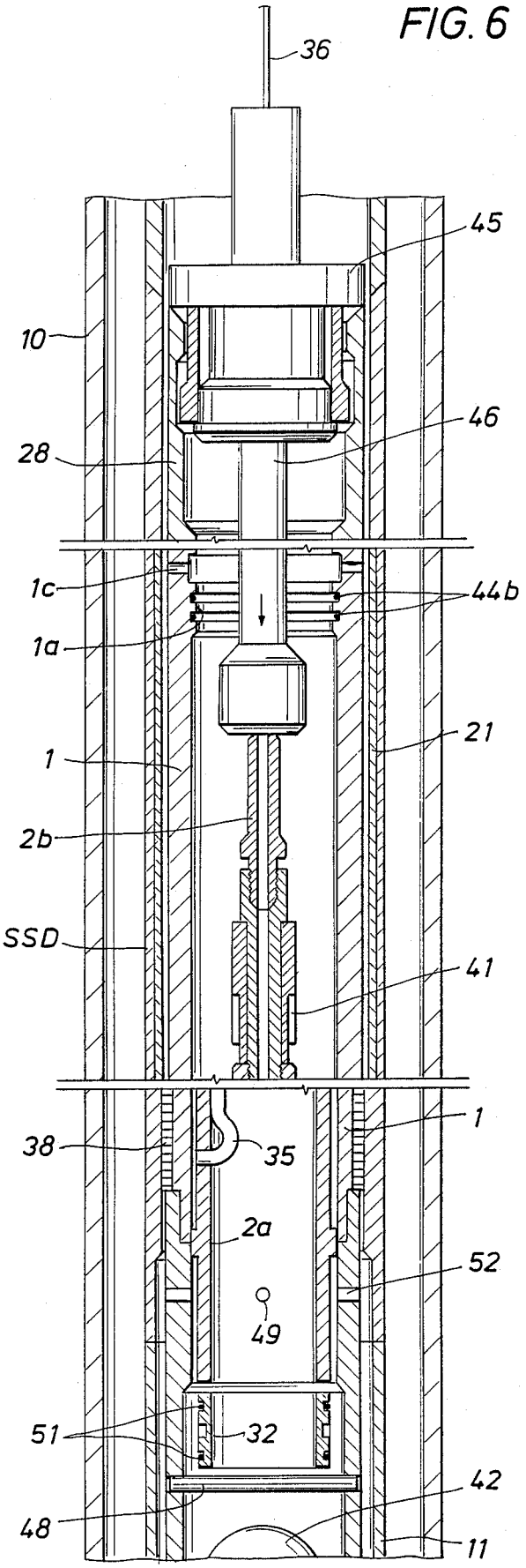
FIG. 6 shows the tool of FIGS. 5A, 5B, and 5C ready for raising after a cycle of pressure measurements have been completed.

FIG. 6 shows the final stage once pressure measurements have been completed and before the tool is raised. By acting on the cable 36, the end fitting 2*b* of the junction sleeve 3 is uncoupled and raised to the surface together with the pressure sensor 31. A fishing tool 45 is then lowered and this fastens onto the anchoring mandrel 28. At the end of its downwards stroke, the fishing tool 45 thrusts the element 2 downwardly by means of an axial arm 46 belonging to the fishing tool, thereby releasing the ring 32 by shearing the pins 51 which used to fix it to the element 1, and causing the ring to move down as far as a transverse abutment rod 48. When this happens the orifice(s) 49 put the spaces inside and outside the element 1 into communication, thereby equalizing the pressures while the tool 1, 2 is raised, with the non-return valve 42, 43 being closed. During subsequent raising of the tool 1, 2, equalization of said pressures may also take place via the channels 1*c* of the element 1.

When a safety valve 20 is provided in the top portion of the production string 11, the valve must be removed in order to allow the tool 1, 2 to be lowered, after which it can be put back into place.

I claim:

1. A tool for measuring the pressure set up in an oil well by an underground formation where the well is drilled, the well being delimited by casing having production string installed therein, said string including a section comprising a sliding sleeve circulating valve, said valve being capable, on command, of putting the space inside the production string into communication with an annular space lying between the production string and the casing by bringing orifices through said sliding sleeve into register with orifices through the wall of said production string, wherein said tool comprises: means designed to be lowered inside the production string and locked at the level of the circulating valve section and further including means for putting said orifices after they have been brought into register into sealed connection with a pressure sensor, the connection being sealed against the pressure reigning in the production string, such that the pressure sensor receives the pressure reigning in the annular space via said orifices and said sealed connection means, the means for putting comprising two coaxial elements capable of sliding telescopically, a first element which is tubular and has an outside diameter which is slightly less than the inside diameter of the production string, and a second element capable of sliding over a limited stroke on an internal bearing surface of the first element and including a duct for providing sealed connection between the pressure sensor and said orifices.

2. A tool according to claim 1, wherein said first element is designed to be suitable for connection to an anchoring mandrel which is maneuverable by means of a tool for lowering or for fishing and which is lockable in the section of the production string constituting the circulating valve.

3. A tool according to claim 2, wherein said second element is capable of taking up a given low position relative the first element by means of an end-of-stroke abutment with the second element being entirely contained within the first element when in its low position.

4. A tool according to claim 3, wherein said second element is capable of taking up a high position relative to the first element as determined by an end of stroke abutment with said duct being put into communication with the orifices of the circulating valve when the second element is in said high position.

5. A tool according to claim 4, wherein said duct opens out onto the outside surface of the second element at a location such that when said element is in its high position the opening of the duct lies in the middle region of the internal bearing surface of the first element and is in communication with at least one channel passing through the wall of the first element and itself communicating via an annular space lying between the outside surface of the first element and the inside surface of the sliding sleeve, with the orifices thereof and of the wall of the circulating valve forming section.

6. A tool according to claim 5, wherein said duct opens out into an annular groove formed in the inside bearing surface of the first element and communicating with the or each channel passing through the wall of said element.

7. A tool according to claim 5, characterized by the fact that it carries the pressure sensor.

8. A tool according to claim 7, characterized by the fact that the pressure sensor is removable mounted thereon.

9. A tool according to claim 8, wherein said second element of the tool includes a tubular junction end fitting at its top end which is reached by said connection duct and which enables said duct to be connected in sealed manner to the pressure sensor.

10. A tool according to claim 9, wherein said pressure sensor is coupled to the end fitting by a separable connection device including fingers co-operating with a system of J-grooves and enabling the pressure sensor and the end fitting to be coupled and then to be uncoupled on command from the ground surface by means of a suspension cable.

11. A tool according to claim 10, wherein said second element includes a tubular bottom portion with the top thereof being pierced by at least one orifice enabling oil to pass through the tool.

12. A tool according to claim 11, wherein the abutment defining the low position of the second element is constituted by a ring fixed inside the first element in non-definitive manner, said ring closing at least one orifice passing through the wall of the first element, and in that said ring after being expelled at the end of tool utilization by means of a fishing tool designed to force the second element to move downwardly relative to the first element, opens said orifice, thereby putting the spaces situated outside and inside the first element into communication with each other.

13. In a borehole of an oil well including a casing disposed within said borehole and a production string disposed within said casing, an annular space being formed between the casing and the production string, said production string including an orifice and a groove means adapted for receiving a locking key, a tool adapted to be disposed within said production string for measuring the pressure of a fluid in said annular space, comprising: a first element disposed within said production string, said first element including an anchoring mandrel means for providing said locking key adapted to mate with said groove means of said production string and a channel disposed through a wall of said first element, said channel of said first element being in fluid communication with said orifice of said production string when said locking key of said anchoring mandrel means mates with said groove means of said production string; and a second element disposed within said first element and telescopically movable between a first non-extended position and a second extended position within said first element, said second element including a channel, said channel of said second element being in fluid communication with said channel of said first element when said locking key of said anchoring mandrel means mates with said groove means of said production string and when said second element is disposed in said second extended position relative to said first element.

14. The tool of claim 13 further comprising:

pressure sensor means for sensing a pressure of said fluid in said annular space; and sleeve means connected to said pressure sensor means adapted for gripping said second element of said tool.

15. The tool of claim 14, wherein said second element comprises receiving means adapted for receiving a portion of the sleeve means, said channel of said second element being in fluid communication with said channel of said first element when said portion of said sleeve means engages said receiving means of said second element and telescopically moves said receiving means of said second element to said second extended position relative to said first element.

16. The tool of claim 15, wherein said pressure sensor means senses the pressure of said fluid in said annular space when said channel of said second element is in fluid communication with said channel of said first element.

17. The tool of claim 16, wherein said first element of said tool further comprises non-return valve means for receiving said fluid disposed in said borehole and allowing said fluid to pass upward through said tool, in one direction, independently of the function of said pressure sensor means in sensing the pressure of said fluid in said annular space.

18. A method of using a tool adapted for measuring a pressure of a fluid disposed in an annular space formed between a casing of a borehole of an oil well and a production string disposed within said borehole, said production string including an orifice in fluid communication with said fluid in said annular space and a groove, comprising the steps of:

lowering a first element of said tool into said production string until a locking key of an anchoring mandrel of said first element mates with said groove of said production string, a channel of said first element being in fluid communication with said orifice of said production string when said locking key mates with said groove; and telescopically rasing a second element disposed within said first element from a first non-extended position relative to said first element to a second extended position, a first end of a channel in said second element being in fluid communication with said channel of said first element when said second element is raised to its second extended position.

19. The method of claim 18, further comprising the steps of:

connecting a pressure sensor to a second end of said channel in said second element thereby placing said pressure sensor in fluid communication with said channel of said first element, said orifice of said production string, and said annular space when said second element is raised to its second extended position.

20. The method of claim 18, wherein the raising step further comprises the steps of:

connecting a sleeve to a pattern of grooves on said second element; and pulling up on said sleeve until said second element is raised from said first non-extended position to said second extended position.

21. The method of claim 20, further comprising the step of:

connecting a pressure sensor to said sleeve prior to performing the connecting step, said pressure sensor being in fluid communication with said fluid in said annular space when said sleeve is pulled up from said first non-extended position to said second extended position thereby sensing the pressure of said fluid in said annular space.

* * * * *